US005571559A

United States Patent [19]

Cathey et al.

[11] Patent Number: 5,571,559

[45] Date of Patent: Nov. 5, 1996

[54] METHOD AND APPARATUS FOR BONDING, COATING AND DYEING YARN

[75] Inventors: Sara A. Cathey, Lake Toxaway; Mike C. Sellers, Hendersonville; Robert A. Spicuzza, Fletcher; William C. Stuckey, Hendersonville, all of N.C.

[73] Assignee: Belding Heminway Co., Inc., New York, N.Y.

[21] Appl. No.: 349,532

[22] Filed: Dec. 5, 1994

[51] Int. Cl.[6] ..... B05D 3/08; B05C 11/00

[52] U.S. Cl. ..... 427/224; 427/177; 427/379; 427/319.9; 427/393.5; 427/428; 427/429; 427/434.7; 118/47; 118/208; 118/405; 118/DIG. 19

[58] Field of Search ..... 427/224, 389.9, 427/379, 393.5, 434.7, 429, 177, 428; 118/47, 405, DIG. 19

[56] References Cited

U.S. PATENT DOCUMENTS

| | | | |
|---|---|---|---|
| 3,110,607 | 11/1963 | McElroy | 427/224 |
| 3,416,874 | 12/1968 | Robin | 427/224 |
| 3,591,407 | 7/1971 | Petersik et al. | 427/224 |
| 3,909,196 | 9/1975 | Birke et al. | 8/140 |
| 3,920,866 | 11/1975 | Lefebvre | 427/224 |
| 3,962,213 | 6/1976 | Flynn | 427/224 |

*Primary Examiner*—Janyce Bell

*Attorney, Agent, or Firm*—Rhodes Coats & Bennett, L.L.P.

[57] ABSTRACT

A method and apparatus for bonding, coating and/or dyeing yarn which impregnates the yarn with a solution containing at least one of a polymer resin, coating or dyestuff dissolved in a flammable solvent/carrier. The solvent/carrier in the impregnated yarn is then ignited to burn away a part of the solvent/carrier from the yarn. A portion of the solvent/carrier remains in the yarn to prevent damage to the yarn. The yarn containing the residual solvent/carrier then is dried at an elevated temperature.

15 Claims, 1 Drawing Sheet

METHOD AND APPARATUS FOR BONDING, COATING AND DYEING YARN

BACKGROUND OF THE INVENTION (1) Field of the Invention

The present invention relates generally to textiles and, more particularly, to a method and apparatus for continuously bonding, coating and/or dyeing yarn.

(2) Description of the Prior Art

Conventionally yarn is bonded, coated and/or dyed by a number of batch or continuous processes. All of these processes require that the solvent carrying the adhesive, coating and/or dye be driven off after processing. For water-based systems this is an energy intensive process. In addition, the waste water containing excess adhesive, coating or dye must be disposed of. For solvent-based systems this also is an energy intensive process. Like water-based systems, the waste solvent containing excess adhesive, coating or dye must be disposed of. Finally, drying the solvent saturated yarn produces air-born solvent vapors which may present a health hazard.

U.S. Pat. No. 3,909,196, issued to Birke et al., teaches a process for the impregnation and subsequent drying of textile material in which the material is treated with an impregnating bath containing an inflammable organic liquid, wherein the material is dried by burning off this liquid. This process was directed to reducing energy consumption rather than environmental concerns. In addition, complete burning off of the organic liquid could damage fragile textile materials, such as yarn.

Thus, there remains a need for a new and improved method and apparatus for bonding, coating and/or dyeing yarn which produces very low quantities of organic emissions while, at the same time, prevents damage to the textile goods.

SUMMARY OF THE INVENTION

The present invention is directed to a method and apparatus for bonding, coating and/or dyeing yarn which first impregnates the yarn with a solution of a polymer resin dissolved in a flammable solvent/carrier. The solvent/carrier in the impregnated yarn is then ignited to burn away a part of the solvent/carrier from the yarn. A portion of the solvent/carrier remains in the yarn to prevent damage to the yarn. The yarn containing the residual solvent/carrier is dried conventionally.

Accordingly, one aspect of the present invention is to provide a method for bonding, coating and/or dyeing the individual fibers of a multi-filament yarn. The method includes the steps of: (a) impregnating the yarn with a solution of a polymer resin dissolved in a flammable solvent/carrier; and (b) igniting the solvent/carrier in the impregnated yarn to burn away a part of the solvent/carrier from the yarn.

Another aspect of the present invention is to provide a method for bonding, coating and/or dyeing the individual fibers of a multi-filament polyamide or polyester yarn. The method includes the steps of: (a) impregnating the yarn with a solution of a polymer resin dissolved in a flammable solvent/carrier; (b) igniting the solvent/carrier in the impregnated yarn to burn away a part of the solvent/carrier from the yarn; (c) halting the burning before all of the solvent/carrier is burned away from the yarn; (d) again impregnating the yarn with the solution of a polymer resin; (e) again igniting the solvent/carrier in the impregnated yarn to burn away at least a part of the solvent/carrier from the yarn; (f) again halting the burning before all of the solvent/carrier is burned away from the yarn; and (g) drying the yarn to remove additional solvent/carrier.

Another aspect of the present invention is to provide an apparatus for use in bonding, coating and/or dyeing the fibers of a yarn. The apparatus includes: (a) a yarn source; (b) a yarn impregnator downstream from the yarn source; (c) a solvent/carrier igniter downstream from the yarn impregnator; (d) a flame extinguisher downstream from the yarn impregnator; (e) a dryer positioned along the pathway downstream from the flame extinguisher; and (f) a yarn collector adapted to draw yarn along a path from the yarn source, and sequentially into contact with the yarn impregnator, the solvent/carrier igniter, the flame extinguisher, and the dryer, and then collect the yarn.

Still another aspect of the present invention is to provide an apparatus for use in bonding, coating and/or dyeing the fibers of a yarn. The apparatus includes: (a) a yarn collector adapted to collect the yarn and pull the yarn along a predetermined pathway; (b) a yarn source at the beginning of the pathway; (c) a yarn impregnator along the pathway downstream from the yarn source, the impregnator being adapted to impregnate the yarn with a solution comprised of a solvent/carrier and a polymer resin; (d) a solvent/carrier igniter along the pathway downstream from the yarn impregnator, the igniter being adapted to ignite the solvent/carrier in the impregnated yarn; and (e) a flame extinguisher along the pathway downstream from the solvent/carrier igniter, the extinguisher being adapted to extinguish flames on the yarn; (f) a second yarn impregnator along the pathway downstream from the yarn source, the second impregnator being adapted to impregnate the yarn with a solution comprised of a solvent/carrier and a polymer resin; (g) a second solvent/carrier igniter along the pathway downstream from the yarn second impregnator, the second igniter being adapted to ignite the solvent/carrier in the impregnated yarn; and (h) a second flame extinguisher along the pathway downstream from the second yarn impregnator, the flame extinguisher being adapted to extinguish flames on the yarn.

These and other aspects of the present invention will become apparent to those skilled in the art after a reading of the following description of the preferred embodiment when considered with the drawing.

DESCRIPTION OF THE PREFERRED EMBODIMENTS

Figure 1:
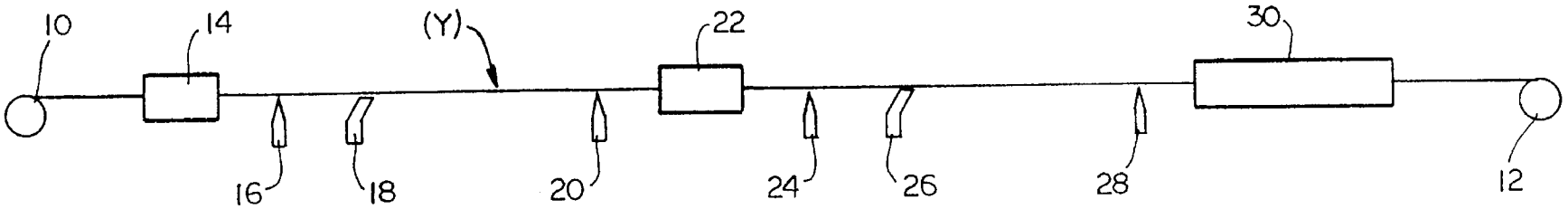
FIG. 1 is a diagrammatic illustration of an apparatus constructed according to the present invention, including optional elements.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to FIG. 1, it will be understood that the illustration is for the purpose of describing a preferred embodiment of the invention and is not intended to limit the invention thereto. As best seen in FIG. 1, an apparatus for bonding, coating and/or dyeing yarn is shown constructed according to the present invention.

The yarn (Y) to be treated in accordance with the process of the present invention is withdrawn from a thread source 10 along a predetermined pathway by a yarn collector 12. The yarn source may be a creel holding a plurality of thread pirns, or packages, with a yarn being taken from each pirn along a predetermined pathway to the yarn collector. For the sake of illustration, however, only one yarn is shown. Yarn collector 12 may be a winder having a tube for each yarn, or a commercially available yarn take-up, such as a Conorapid, manufactured by Matex GmbH.

A yarn impregnator 14 is positioned along the predetermined pathway downstream from yarn source 10. Impregnator 14 is adapted to impregnate the fibers of the yarn with a solution of a fiber bonding material dissolved in a flammable solvent/carrier, and may be of various configurations to accomplish this purpose. For example, impregnator 14 may be an applicator positioned to direct the solution against the yarn. Alternatively, impregnator 14 may be a bath through which the yarn travels, or a pad or transfer roller contacting the yarn.

Flame extinguisher 16 is positioned along the predetermined pathway downstream from impregnator 14, and is adapted to prevent flames from subsequent treatment steps from moving upstream along the yarn. Extinguisher 16 may be, for example, an air knife which directs a pressurized stream of air against the yarn or a vacuum source which withdraws the flame.

Solvent/carrier igniter 18 is positioned along the predetermined pathway downstream from extinguisher 16, and is adapted to ignite the solvent/carrier on the yarn. Igniter 18 may be, for example, a lighted gas jet positioned so that its flame intersects the predetermined pathway.

A second flame extinguisher 20 is positioned along the pathway and downstream of igniter 18, and is adapted to halt burning before all of the solvent/carrier is removed. Extinguisher 20 also serves as a safety device to prevent flames from moving further downstream. The structure of extinguisher 20 may be the same as that of extinguisher 16. The distance between igniter 18 and extinguisher 20 is such that, considering the speed of the yarn and the type of solvent/carrier used, sufficient time will be allowed prior to extinguishing of the flame for only part of the solvent/carrier to be burned away.

For some purposes, the apparatus described so far may be sufficient to produce a yarn with adequate fiber bonding. If so, the apparatus will next include a dryer, such as described hereinafter, immediately downstream from the foregoing elements to remove residual solvent/carrier from the yarn. For optimum fiber bonding, however, it is desirable for the yarn to undergo a double impregnation. In such case, the apparatus will also include the additional elements described below.

As seen in FIG. 1, these additional elements, all being positioned along the predetermined pathway, include a second impregnator 22 downstream from extinguisher 20, a third flame extinguisher 24 downstream from impregnator 22, a second solvent/carrier igniter 26 downstream from extinguisher 24, and a fourth flame extinguisher 28 downstream from igniter 26. All of these elements may have the same construction as their preceding counterparts.

As with igniter 18 and extinguisher 20, The distance between igniter 26 and extinguisher 28 is such that, under the conditions used and with the materials employed, sufficient time will be allowed prior to extinguishing of the flame for part, but not all, of the solvent/carrier to be burned away.

A drying oven 30 is positioned downstream of extinguisher 28 and adjacent the predetermined pathway, so that the yarn passes through the oven to remove residual solvent/carrier. The length of oven 30 will depend on several variables including the drying temperatures used, the amount of drying required, and the speed of the yarn. However, a drying oven having a length of between about 1 to 50 feet, e.g., 16 feet, with an adjustable temperature, will normally be adequate. A drying temperature in the range of between about 200° F. to 700° F. and preferably between about 400° F. to 450° F. can be used. This sometimes is higher than normal yarn drying temperatures since such a low concentration of solvent/carrier remains.

In operation, yarn (Y) is withdrawn from yarn source 10 along the predetermined pathway by yarn collector 12 and into engagement with yarn impregnator 14 whereat the fibers of the yarn are impregnated with a solution of a polymer resin dissolved in a flammable solvent/carrier, which coats the individual fibers forming the yarn.

The polymer resin used is selected from the group consisting of organic coating resins. However, in the preferred embodiment, a solvent/carrier soluble polyamide resin is used.

Various flammable organic solvent/carriers can be used to dissolve the polymer resin. When taking into consideration factors such as cost, the nature of combustion products, toxicity, and ease of handling, preferred solvent/carriers include methanol, ethanol, isopropanol, and n-propanol. Other burnable organic solvents can be used separately or in mixture with the aforementioned alcohols. In addition, other additives, such as water, can be added to the solvent/carrier to control the flame characteristics.

After impregnation, the yarn is conveyed downstream past flame extinguisher 16 and into engagement with solvent/carrier igniter 18 to ignite the solvent/carrier on the yarn. After ignition, most, but not all, of the solvent/carrier is burned away, leaving the polymer resin binding the fibers, with sufficient residual solvent/carrier still on the yarn to prevent any significant yarn degradation. In order to prevent burning of all of the solvent/carrier, and damage to the yarn, further movement of the yarn along the predetermined pathway brings the burning section into engagement with a second flame extinguisher 20 which halts further burning and also prevents flames from moving further downstream.

The yarn may then be dried to remove remaining solvent/carrier and then collected on a bobbin or other suitable collection device. For optimum fiber bonding, however, the yarn will be further treated by subjecting the yarn to a second impregnation with the solution described above using second impregnator 22. Following impregnation, the solvent/carrier on the yarn will be ignited with second solvent/carrier igniter 26 and the flame will then be extinguished with flame extinguisher 28 prior to complete burning of the solvent/carrier.

After the second stage impregnation, including solvent/carrier removal, the yarn is dried by passing it through drying oven 30. The dried yarn with the individual fibers bonded together is then collected on yarn collector 12.

EXAMPLE

While the prior art described above has suggested that solvent burning can be used to dry various textile materials, the procedure has specifically been applied to fabrics. When burning, as disclosed in the prior art is actually tried with yarns, e.g., sewing thread, however, it is found that the process is not suitable since the burning degrades the physical properties of the yarn. This difference is believed to be due to the fact that there is a significantly greater surface area to solvent ratio present with yarns compared to fabrics. In order for the desired results of the present invention to be achieved, it is necessary to halt burning of the solvent/carrier before all solvent/carrier is removed from the yarn. By doing so, it has been found that the degradation of the yarn can be avoided, while accomplishing the objective of rapid and economical drying of the yarn.

The difference is illustrated by this example in which a polyamide yarn having a total denier of 630 was impregnated with a 100% solvent/carrier. The solvent/carrier was then ignited and permitted to burn for the lengths of time noted below. The flame was then extinguished and the resulting yarn temperature and strength of the thread, as measured by breaking strength, were measured.

The following results were obtained:

TABLE

| Burn Time (sec.) | Yarn Temperature (°C.) | Breaking Strength (g/denier) |
|---|---|---|
| 0.25 | 52 | 9.0 |
| 0.27 | 53 | 9.0 |
| 0.29 | 62 | 9.0 |
| 0.31 | 68 | 9.0 |
| 0.33 | 71 | 8.6 |
| 0.35 | 81 | 8.3 |
| 0.37 | 96 | 7.2 |
| 0.39 | 105 | 4.3 |

The above data shows that a measured yarn temperature after burning of at about 81° C., and preferably from between about 60° C. and 70° C. is desired to avoid yarn degradation. The time required to achieve this yarn temperature will depend on the size of the yarn, the composition of the solvent/carrier system and the residual amount of solvent/carrier left which controls the yarn temperature.

Certain modifications and improvements will occur to those skilled in the art upon a reading of the foregoing description. By way of example, the reclamation of heat evolved from the burning of the solvent/carrier can be applied to the conventional drying oven to minimize energy consumption. Also, in the case of sewing threads, various additives required for satisfactory performance such as lubricants, softeners, etc. can be applied with the appropriate equipment. Also, by way of example, a solvent/carrier blended system could be devised that would produce self-extinguishing characteristics that would yield comparable results to the physical flame extinguishers described herein. Also, in the case of dyeing, this would include coloration by traditional dyestuffs which are soluble and can enter into the fiber as well as insoluble pigments which are typically mechanically bound to the surface of a substrate by a polymeric binder. Also the invention is applicable to a broad range of textile fibers, yarns and yarn based products.

We claim:

1. A method for bonding, coating and/or dyeing the individual fibers of a multi-filament yarn, said method including the steps of:

(a) impregnating said yarn with a solution of a polymer resin dissolved in a flammable solvent/carrier; and (b) igniting the solvent/carrier in the impregnated yarn to burn away only a part of said solvent/carrier from the yarn, wherein the burning is halted before all of the solvent/carrier is burned away from the yarn.

2. The method according to claim 1, further including drying the yarn after burning to remove additional solvent/carrier from the yarn.

3. The method according to claim 1, wherein said yarn is selected from the group consisting of polyamide and polyester.

4. The method according to claim 1, wherein said polymer resin is selected from the group consisting of organic coating resins.

5. The method according to claim 1, wherein said solvent/carrier is selected from the group consisting of methanol, ethanol and isopropanol.

6. The method according to claim 1, further including again impregnating said yarn with said solution of a polymer resin, and again igniting the solvent/carrier after the second impregnating step to burn away a part of the solvent/carrier.

7. The method according to claim 1, wherein said impregnating is achieved by padding the yarn with said solution of a polymer resin.

8. The method according to claim 1, wherein said solvent/carrier is ignited by passing the yarn through a flame.

9. A method for bonding, coating and/or dyeing the individual fibers of a multi-filament yarn, said method including the steps of:

(a) impregnating said yarn with a solution of a polymer resin dissolved in a flammable solvent/carrier;

(b) igniting the solvent/carrier in the impregnated yarn to burn away only a part of said solvent/carrier from the yarn;

(c) halting the burning before all of the solvent/carrier is burned away from the yarn;

(d) again impregnating said yarn with said solution of a polymer resin;

(e) again igniting the solvent/carrier in the impregnated yarn to burn away only a part of said solvent/carrier from the yarn;

(f) again halting the burning before all of the solvent/carrier is burned away from the yarn; and (g) drying said yarn to remove additional solvent/carrier.

10. An apparatus for use in bonding, coating and/or dyeing the fibers of a yarn, said apparatus comprising:

(a) a means for supplying said yarn;

(b) a yarn impregnator downstream from said yarn source;

(c) a solvent/carrier igniter downstream from said yarn impregnator;

(d) a flame extinguisher downstream from said yarn impregnator for halting the burning before all of the solvent/carrier is burned away from the yarn;

(e) a dryer positioned along said pathway downstream from said flame extinguisher; and (f) a yarn collector adapted to draw yarn along a path from said yarn source, and sequentially into contact with said yarn impregnator, said solvent/carrier igniter, said flame extinguisher, and said dryer.

11. The apparatus according to claim 10, further including a flame extinguisher along said pathway between said yarn impregnator and said solvent/carrier igniter.

12. The apparatus according to claim 11, wherein said flame extinguisher is an air jet positioned to contact said pathway with a pressurized air stream.

13. An apparatus for use in bonding, coating and/or dyeing the fibers of a yarn, said apparatus comprising:

(a) a yarn collector adapted to collect said yarn and pull said yarn along a pathway;

(b) a means for supplying said yarn at the beginning of said pathway;

(c) a yarn impregnator along said pathway downstream from said yarn source, said impregnator being adapted to impregnate said yarn with a solution comprised of a solvent/carrier and a polymer resin;

(d) a solvent/carrier igniter along said pathway downstream from said yarn impregnator, said igniter being adapted to ignite the solvent/carrier in the impregnated yarn; and (e) a flame extinguisher along said pathway downstream from said solvent/carrier igniter, said extinguisher being adapted to extinguish flames on said yarn before all of the solvent/carrier is burned away from the yarn;

(f) a second yarn impregnator along said pathway downstream from said yarn source, said second impregnator being adapted to impregnate said yarn with a solution comprised of a solvent/carrier and a polymer resin;

(g) a second solvent/carrier igniter along said pathway downstream from said yarn second impregnator, said second igniter being adapted to ignite the solvent/carrier in the impregnated yarn; and (h) a second flame extinguisher along said pathway downstream from said second yarn impregnator, said flame extinguisher being adapted to extinguish flames on said yarn before all of the solvent/carrier is burned away from the yarn.

14. The apparatus according to claim 13, further including a dryer positioned along said pathway downstream from said flame extinguisher.

15. The apparatus according to claim 13, further comprising a third flame extinguisher along said pathway downstream from said yarn impregnator, said extinguisher being adapted to prevent flames from moving upstream along said yarn, and a fourth flame extinguisher along said pathway downstream from said second yarn impregnator, said fourth extinguisher being adapted to prevent flames from moving upstream along said yarn.

* * * * *